US009349230B1

(12) United States Patent
Doyen et al.

(10) Patent No.: US 9,349,230 B1
(45) Date of Patent: May 24, 2016

(54) SYSTEMS AND METHODS FOR IMPLEMENTING TARGETED NETWORK COMMUNICATION AND AUTOMATION CAPABILITIES IN A DISTRIBUTED ACCESS CONTROL SYSTEM

(71) Applicant: ROCKWELL COLLINS, INC., Cedar Rapids, IA (US)

(72) Inventors: William George Doyen, Annapolis, MD (US); Kyle Hawver, Middle River, MD (US); Tyler Harper, Denton, MD (US); Simon Critchley, Cheshire (GB)

(73) Assignee: Rockwell Collins, Inc., Cedar Rapids, IA (US)

( * ) Notice: Subject to any disclaimer, the term of this patent is extended or adjusted under 35 U.S.C. 154(b) by 148 days.

(21) Appl. No.: 14/307,516

(22) Filed: Jun. 18, 2014

(51) Int. Cl.
*G07C 9/00* (2006.01)

(52) U.S. Cl.
CPC ..... *G07C 9/00007* (2013.01); *G07C 9/00103* (2013.01)

(58) Field of Classification Search
None
See application file for complete search history.

(56) References Cited

U.S. PATENT DOCUMENTS

2007/0096870 A1* 5/2007 Fisher ..... 340/5.53

* cited by examiner

*Primary Examiner* — Daniell L Negron
(74) *Attorney, Agent, or Firm* — Ronald E. Prass, Jr.; Prass LLP

(57) ABSTRACT

A system and method are provided for providing communications via security and distributed access control systems that dynamically alter security protocols and security-associated mailing lists based on sender, receiver and/or message content. Exemplary embodiments provide individual stakeholders with an ability to transmit information to select groups or sub-groups, where appropriate, to provide broadcast communications of information that may be specifically applicable to members of those groups or sub-groups. The groups and/or sub-groups may be ad hoc or according to some predetermined scheme (including predetermined databases of lists designated by one or more of the stakeholders). In embodiments, all coordination of individual messaging will reside in, or be cleared through, a central coordination facility. Security and access control may be included in the databases to be automatically associated with the information provided to the receiving nodes.

23 Claims, 3 Drawing Sheets

SYSTEMS AND METHODS FOR IMPLEMENTING TARGETED NETWORK COMMUNICATION AND AUTOMATION CAPABILITIES IN A DISTRIBUTED ACCESS CONTROL SYSTEM

BACKGROUND

1. Field of the Disclosed Embodiments

This disclosure relates to systems and methods for providing communications via security and distributed access control systems that dynamically alter security protocols and security-associated mailing lists based on sender, receiver and/or message content.

2. Related Art

World events have led to ever increasing vigilance in controlling access to spaces, equipment and/or controlled communications and computing components. This increased vigilance has led to large numbers of increasingly-sophisticated clearance procedures for authorizing such access. Some of these clearance procedures are locally implemented using in-house databases for providing individual access to one or more of a particular space, a particular piece of equipment, or a particular device. Increasingly, however, there is a need to share individual entity controlled databases to grant access to non-locally controlled spaces, equipment or devices. There are certain circumstances in which a more global access needs to be provided to a particular space, piece of equipment or device component. In these circumstances, one entity may have immediate physical control over the particular space, piece of equipment or device component, but individuals from one or more related entities may seek to be granted access to the particular space piece of equipment or device component.

Earlier security paradigms required that one controlling entity exercising immediate physical control over the particular space, piece of equipment or device component would require that the other entities whose individuals desired to be granted access would provide clearance information to the one controlling entity. In certain scenarios, this paradigm has become increasingly unworkable.

There are those who believe that there is a no more pressing example of the requirement for enhanced vigilance than with respect to access to mass transportation and/or transit, particularly including access to airline transportation. As the requirements for vigilance in this regard have significantly increased in the years since the 9/11 attacks in the United States, a traveler knows that security checkpoints at airports have become increasingly sophisticated. Unfortunately, this sophistication, combined with legislated and/or administratively imposed security procedures, has often led to tremendous bottlenecks at the security checkpoints. Additionally, this is precisely the type of scenario that does not lend itself to a single overarching controlling entity, for example an individual airport authority, collecting clearance data on all individuals desiring to gain access to flights including passengers, aircrew members, and maintenance and/or security personnel.

Here, against a heightened security backdrop balanced with some desire to reduce the level of inconvenience, and the frustration that is attendant in that inconvenience for individual members of the above broad categories attempting to gain access, increasing attention has been paid to involving one or more external coordination facilities or clearinghouses in a process for pre-clearing certain individuals. Frequent travelers are able to gain pre-clearance through, for example, the CLEAR® system, which promises to allow individuals, once pre-registered, to clear security in less than five minutes via exclusive "CLEARlanes" at airport security checkpoints. These expedited "lanes" generally allowing those individuals carrying some physical token indicating their pre-registration to skip the extensive security lines and to proceed straight to the security screening checkpoints. Albeit that these procedures may expedite our arrival at security checkpoints, once there, the individuals may remain subject to standard screening procedures.

Even these screening procedures, however, tend to be cumbersome for individuals including aircrew members, as well as other airline personnel and employees. All efforts have been made to accelerate procedures for these individuals based on their routine requirement to pass through security checkpoints, and a level of inherent trust in these individuals based on their employment by an airline. These efforts may generally provide a model for central clearing house controlled dispersed access to spaces, equipment and/or device components.

SUMMARY OF THE DISCLOSED SUBJECT MATTER

The example implementation for an expedited distributed security access program discussed in the following paragraphs will help frame the basis for the disclosed exemplary embodiments. Those exemplary embodiments, as will be described in detail below, seek to leverage certain aspects of the expedited distributed security access program and the network(s) on which it is hosted. The disclosed exemplary embodiments propose schemes to enhance overall situational awareness for individuals, groups, sub-groups and stakeholders by increasing targeted communication between the individuals, groups, sub-groups and stakeholders. The example implementation discussed below, however, is not intended to limit the disclosed exemplary schemes to just this single scenario.

Airline aircrew members often benefit from a limited convenience of accelerated screening through airport security systems based on their ability to present multiple identifications, in a standard and easily recognizable form, to screening personnel at particular, and generally separate, security screening stations. The fact that the aircrew members are carrying the multiple forms of standard and easily-recognizable identification provides a certain confidence to the screening personnel that the aircrew members are pre-cleared by the individual airlines for which they work. This confidence alone, however, is not enough to dispense with all screening procedures. Under a currently-employed scheme, aircrew members are generally allowed to bypass the "standard" security lines, but they are conventionally still subject to a security screening, which may be appropriately abbreviated or expedited.

Even this accelerated security screening was, however, considered by many aircrew members to be inappropriately intrusive given their status as "trusted" airline employees. Aircrew members consider that a necessity for any screening of their persons, carry-on bags and/or packages whatsoever is unwarranted based on their position. The position of many aircrew members is that the airlines have completely pre-screened them based on extensive background checks and the like, which are often exhaustively routinely updated. As such, it is a broad consensus among many aircrew members that they should be afforded the opportunity to simply "flash their badge" and bypass the security screening altogether.

In an effort to address aircrew member sensitivities and concerns in this regard, while maintaining some requisite level of immediate clearance oversight, particular systems have been developed and deployed that generally provide an opportunity for aircrew members to present themselves to a security representative at a separate "private" security checkpoint that does not include the standard inconvenient and/or intrusive screening mechanisms and processes. A generally accepted industry standard screening acceleration system is the ARINC® proprietary CrewPASS® airport screening and identification verification service, which has been largely adopted industry wide under the trade name "Known Crew Member" or "KCM." The KCM service provides network connected workstations in a form of local communication terminals at each of the separate security checkpoints at many airports throughout the United States. The service connects these workstations via a central coordination facility to dozens of airline-controlled employee databases.

An interaction between an aircrew member and a Transportation Security Officer (TSO) at the separate security checkpoint involves the aircrew member presenting his or her airline-provided credentials, along with a separate government-issued form of picture identification to the TSO. The TSO then enters the individual's airline and employee identification number into the local communication terminal to be transmitted in real-time to the central coordination facility. As implemented, the central coordination facility provides a communication hub/interface between the many TSOs operating concurrently at the many separate security checkpoints in airports nationwide with the many airline-controlled employee databases proprietarily held and controlled by the airlines themselves. Upon receiving a clearance request from a particular TSO at a particular separate security checkpoint, the central coordination facility queries the particular airline's database for confirmation of a current status for the aircrew member that is the subject of the clearance request.

As implemented, the central coordination facility confirms with the airline an employment status of the aircrew member and/or authorization for the aircrew member to participate in the separate security screening process and to be granted access to airline equipment. Once airline confirmation is received, the central coordination facility, as currently implemented, returns confirming identifying information for the aircrew member, including a picture of the aircrew member, from the airline's database along with other additionally-stored identifying information directly to the TSO's local communication terminal for TSO visual comparison and confirmation. With the information confirmed, the TSO allows the aircrew member to pass without being further encumbered, except in a small number of instances where additional random screening may still occur. In the current implementation, the entire process generally takes less than thirty seconds to complete the end-to-end communication and return the aircrew member verifying information to the TSO.

KCM thus provides a risk-based security program in which a particular group of individuals, having already been subject to some form of pre-clearance or vetting, are expedited through a screening process at airport security sites as examples of points of entry access. The local communication terminal may be typically configured with a barcode reader and a mobile computing device (laptop computer), the mobile computing device having a cellular network communicating capacity.

The KCM system, as currently deployed, is limited in its capabilities. The TSO enters the information regarding the aircrew member presenting credentials, including reading barcode information from the aircrew member's credentials, or entering specific information associated with those credentials such as, for example, the employee identification number. The entered information is translated over a secure network to the central coordination facility, which reaches out to the proprietary databases held by the individual airlines. A specific query is sent regarding the airline employing the aircrew member that has presented himself or herself to be cleared. Airline proprietary database confirmation regarding acceptance or refusal of the credentials is then passed to the central coordination facility, which, in turn, passes the information directly to the mobile computing device associated with the separate security station and the TSO to which the aircrew member presented himself or herself.

In a coordinating application, certain implementations of KCM may provide an opportunity for a TSA organization, within the airport for example, to manage an overall account for that airport. Much of this management is generally administrative in order to facilitate the process for individual TSOs logging into the airport's internal system of individual users, or as members of a group log-in for overall access to the airport's system. Decisions regarding how to administer local system access internal to individual airports maybe under the purview of the individual airport TSA administrator. A dashboard capability, including information of historical tracking importance, may also be provided in order to obtain information, for example, regarding system usage, such as, for example, an individual aircrew member clearance access provided over specified periods of time. Other capabilities of the system include an opportunity for aircrew members to login in a manner that allows them to confirm or update the association of their credentials.

As implemented, therefore, KCM provides an in-place coordinating network, but which has to date been limited to addressing a very specific set of operating requirements and objectives. This implementation balances a desire to provide convenience for individual aircrew members with a need to maintain a fidelity of system information that may be provided across the KCM network.

Based on an in-place existence of a particularized communication network to a specific purpose, including a level of security assurance proper for the characteristics of the personal identifying data being passed bi-directionally between system components, it may be advantageous to increase the capabilities and/or access to information provided across the in-place network to a number of additional beneficial uses.

Exemplary embodiments of the systems and methods according to this disclosure may provide additional communications capabilities across an in-place network security system that may afford an opportunity to dynamically alter security and operational information appropriate to individual operators at individual security workstations.

Exemplary embodiments may provide individual stakeholders with an ability to transmit information to select groups or sub-groups, where appropriate, to provide broadcast communications of information that may be specifically applicable to members of those groups or sub-groups. In this regard individual stakeholders may include, for example, TSA headquarters, regional transportation and airport security managers, or individual airport transportation and airport security managers. The groups and/or sub-groups may be ad hoc or according to some predetermined scheme (including predetermined databases of lists designated by one or more of the stakeholders). It is anticipated that all coordination of individual messaging will reside in, or be cleared through, the central coordination facility, in the manner that the basic system operates today.

Exemplary embodiments may provide a capacity to broadcast alert information as to security events, operational occurrences and impacts, and/or administrative notifications at varying levels of security and according to varying priorities to specifically-identified groups and/or sub-groups that may require, or benefit from, the information.

In embodiments general administrative data may be, for example, broadcast for immediate display on each individual mobile communicating device of each separate security station.

In embodiment, certain security and operational information, including procedural instructions, may be delivered to individual mobile communicating devices with an alert that requires input from the TSO using the particular mobile communicating device at the particular separate security station to interact with the mobile communicating device in order to gain access to the broadcasts information. Such interaction may entail entering biometric or other password information of the TSO in order to gain access to the content of the broadcast message Exemplary embodiments may additionally provide a capacity by which individual TSOs may be able to input capturable information at the mobile computing workstations regarding anomalous occurrences to be captured by the central coordination facility for later analysis. Such information may include lists of individual events that may be selectable from, for example, a drop-down menu in order to facilitate feedback from the individual TSO security stations to the central coordination facility for analysis.

Exemplary embodiments may provide certain categories of administrative and operational information to individual aircrew members' properly-registered personal mobile communicating devices. The transmission of these categories of administrative and operational information to the individual aircrew members' personal mobile communicating devices may be triggered by identification and localization of a particular aircrew member at a particular separate security checkpoint, or otherwise having passed therethrough within a specified period of time.

In embodiments in which barcodes on individual aircrew members' credentials may be replaced, or otherwise supplemented, by other wireless communications capabilities including, for example, RFID chips, the capabilities of the disclosed schemes may be expanded to separately identify a position of an aircrew member within the airport boundaries based on RFID monitoring, thereby triggering the passage of pertinent information to the individual aircrew member's personal mobile communicating device.

These and other features and advantages of the disclosed systems and methods are described in, or apparent from, the following detailed description of various exemplary embodiments.

BRIEF DESCRIPTION OF THE DRAWINGS

Various exemplary embodiments of the disclosed systems and methods for providing communications via security and distributed access control systems that dynamically alter security protocols and security-associated mailing lists based on sender, receiver and/or message content, will be described, in detail, with reference to the following drawings, in which.

DESCRIPTION OF THE DISCLOSED EMBODIMENTS

Figure 1:
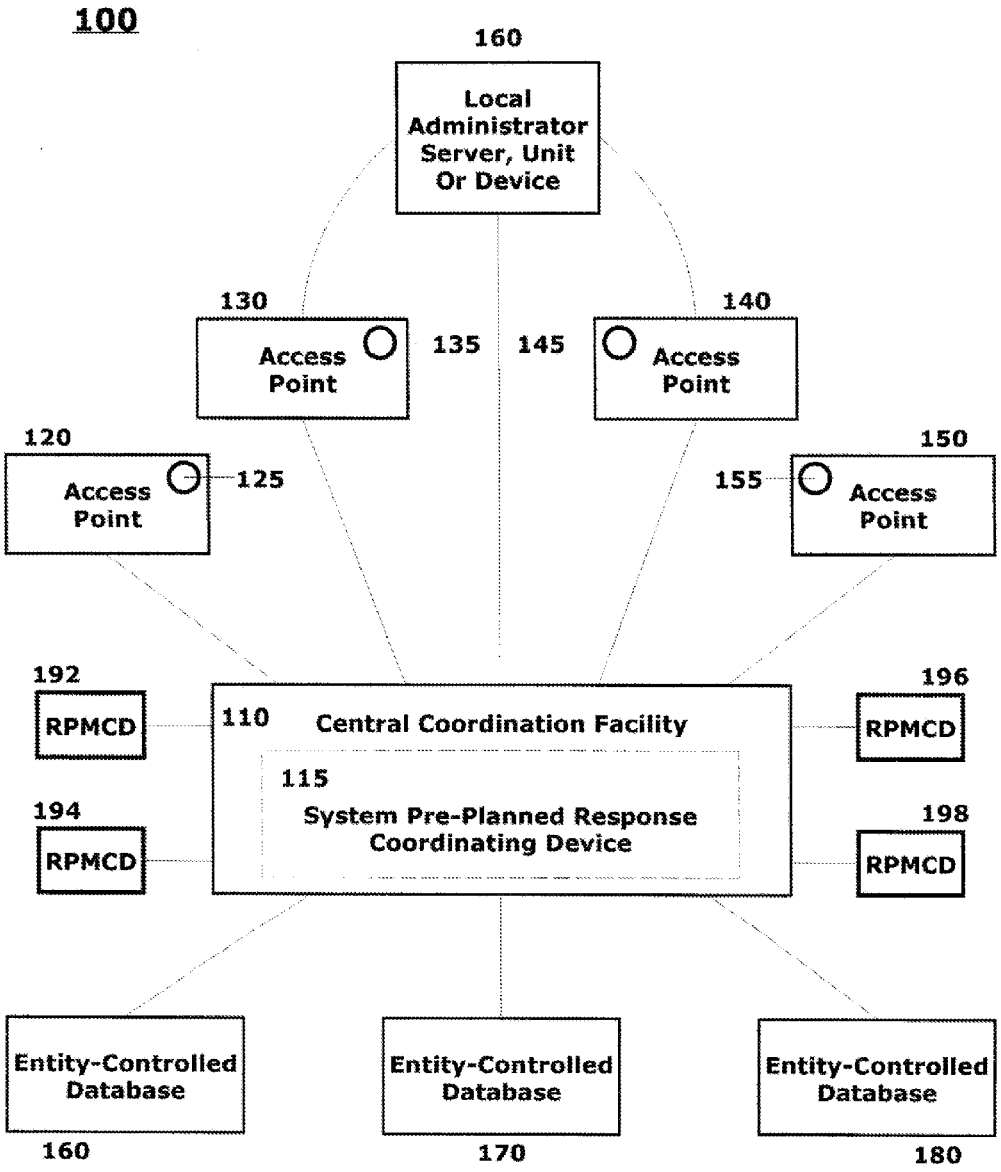
FIG. 1 illustrates an exemplary overview of an operating environment in which secure and targeted communication schemes may be implemented according to this disclosure.

The disclosed systems and methods for providing communications via secure and distributed access control systems that dynamically alter security protocols and security-associated mailing lists based on sender, receiver and/or message content, will generally refer to this specific utility for those systems and methods. Exemplary embodiments will be described in this disclosure as being particularly adaptable to use in an advanced airport, airline, and aircrew member communications scenario, where additional communications may be triggered by identification of, for example, individual aircrew members via a particular security clearing procedure undertaken in a streamlined fashion at separate security checkpoints according to the routine described above. These descriptions should not be interpreted as specifically limiting the disclosed schemes to any particular configuration of a networked communicating system for triggering the passage of particular security, operating, logistic or administrative information to individuals, sub-groups or groups, as stakeholders with access to the networked communicating system may define. In fact, the systems and methods according to this disclosure may be equally applicable to any person-in-the-loop or automated security procedure that an individual may use for gaining access to controlled spaces, pieces of equipment and/or computing or communicating device components in which the individual's attempt to gain access may trigger automatic provision of certain security, operating, logistic or administrative information to the individual via a particularly-configured security access communicating device, and/or via the individual's properly-registered personal mobile communicating device. Any ability to augment a central coordination facility, or central clearing house, with an appropriate scheme for more efficiently sending some amount of pre-formatted and/or security-augmented information to one or more individuals, sub-groups, groups, as any of the stakeholders may prescribe, based on a triggering access event is contemplated as being covered by this disclosure.

Specific reference to, for example, the above-discussed scenario for clearance of individual aircrew members at separate security checkpoints in airports as providing a particular example of where the systems and methods according to this disclosure may be particularly advantageously employed should be understood as being exemplary only, and not limiting the disclosed schemes, in any manner, to any particular class of access control units or processes, or to any particular communication link or protocol for implementing the disclosed schemes.

Features and advantages of the disclosed embodiments will be set forth in the description that follows, and in part will be obvious from the description, or may be learned by practice of the disclosed embodiments. The features and advantages of the disclosed embodiments may be realized and obtained by means of the instruments and combinations of features particularly pointed out in the appended claims.

Various embodiments of the disclosed systems and methods are discussed in detail below. While specific implementations are discussed, it should be understood that this is done for illustration purposes only. A person skilled in the relevant art will recognize that other components and configurations may be used without departing from the spirit and scope of the disclosed embodiments.

KCM, in a current installation, is essentially limited to making an aircrew member passage via a particular streamlined access protocol authorized or non-authorized. The network, however, provides a significant capacity for growth, particularly because it is in-place, with the required central coordination facility and network communication backbone, at this time. In installations, the disclosed schemes propose to provide a series of pre-planned responses to certain situations (triggering events), and otherwise for data collection and analysis purposes. Any menu providing a list of pre-planned responses may associate with each of those pre-planned responses a particular group or sub-group of recipients for receipt, as well as automatically assigning a particular security or access level for the information such that the information is provided directly on a display, or as an interactive scheme requiring some response from the user to extract the details of the information from the display. Information further may be individually targeted to any single node.

Beyond certain surface similarities with KCM, and an ability to leverage familiarity with the KCM systems and such an in-place infrastructure, the disclosed schemes may generally incorporate a queue management application to embody the triggering mechanism for pushing security, operating logistic and/or administrative information according to a pre-determined scheme to one or more end users or nodes. As will be discussed specifically in greater detail below, the disclosed schemes may migrate certain logistic components, particularly for aircrew monitoring, onto an available user market that is familiar with the security access provisions that are already provided. In certain more comprehensive embodiments, which may be considered more advanced, widely-proliferated camera connectivity, including cooperating cameras at separate security stations located in or associated with the mobile communicating terminals at those separate security stations, may provide a capacity for instant feedback when anomalous situations or irregularities arise. Facial recognition software may be, for example, housed locally and/or at the central coordination facility in order to provide more robust, accurate and even automated access authorizations and feedback triggers.

In general, the disclosed embodiments provide a capability for stakeholders to transmit to ad hoc or selected pre-established lists of recipients security alerts, operating information, logistic information (including, but not limited to, equipment availability information, weather reports and scheduling data) and/or administrative notes to cooperating communicating devices at fixed locations within a particular area, particularly those fixed locations that provide security access screening to certain groups of individuals. Provision of information to cooperating personal mobile devices for members of the certain groups of individuals may be triggered by presentation of those members to the security access screening locations for authorization and/or access. The elements of transmitted information may each have associated with them appropriate levels of security in order that non-authorized access to the information is limited while providing broadest dissemination available to participating individuals, subgroups and groups.

In the airport security scenario, TSOs operating components of the access manager system may be afforded an opportunity under the disclosed schemes to note irregularities that they detect in operation of the system or otherwise. In a specific operating scenario, a TSO may be provided an opportunity to alert the central coordination facility of an anomalous situation, or an irregularity, in operations at or in a vicinity of a separate security checkpoint to which the TSO is assigned. Certain detected conditions may also trigger an automated alert. In response, a response message may be generated and forwarded to the TSO to walk him or her through an automated scheme for responding to, and/or providing details of, the irregularity or the anomalous situation. In this manner, remote stakeholders may be provided a capacity by which to interact "on-scene" with the TSOs to address the anomalous situation or irregularity.

In other embodiments, in instances where irregular events occur, such events may trigger an automatic collection of additional information by the access manager program itself in an effort to identify anomalies and take automated corrective actions to address such anomalies. Differing levels of reporting, depending on the nature of the anomaly, may be provided to the central coordination facility for review, archiving and analysis. The level of automation may produce an information packet that will be automatically evaluated by the central coordination facility such that instructions may be forwarded back to the individual TSO directing, or reminding, the TSO of those actions that should be taken to address the particular anomalous situation, or simply asking the TSO to provide additional defining information.

In instances, for example, where a particular access manager may be rendered inoperative, guidance may be provided to a particular TSO to switch to a separate access manager. On-call engineering may be automatically notified to address the anomalous situation.

When individual access authorization identification information returned by the central coordination facility to the TSO, for example, does not match the individual presenting himself or herself to the TSO, e.g., a returned picture image is not a picture of the individual, the TSO may be directed to initiate a pre-planned response that collects the currently-presented information, as well as other information, regarding the individual presenting himself or herself, including an option to capture, via a co-located camera, an image of the individual. Guidance may be further provided, for example, to involve a TSO supervisor, or to alert law enforcement individuals to the need to undertake monitoring and/or apprehension of the individual. As such, individual information may continue to be captured by the access manager, and in a coordinated manner, or separately, guidance may be provided to the individual TSO to take certain actions to improve security access, and streamline processing of individual requests for security access.

In embodiments, the disclosed systems are anticipated to include reliance on the capture of biometric information. The disclosed schemes may cooperate to vet this information against expanding numbers of cross-referenced access control lists. It is anticipated that the disclosed systems may support scenarios in which an individual may be granted monitored access to the secure area in the separate security checkpoint in order that further actions taken by the individual may be monitored in a controlled manner, and/or law enforcement response, including apprehension, may occur in a controlled manner at a position of a law enforcement officer's choosing rather than at the bottleneck of the separate security checkpoint. The disclosed schemes provide individual stakeholders controlling communications to set the parameters by which such responses may occur.

As is mentioned above, cameras are becoming ubiquitous in inclusion in most mobile computing and/or communicating devices. As such a capacity to integrate automated, or on-call, access to a camera capability to capture information regarding individuals presenting themselves to the separate security checkpoint, or to otherwise capture circumstances of security and operational occurrences in a vicinity of the separate security checkpoint, may prove beneficial. Real-time data collection may be facilitated through the use of the camera including, for example, in the rare occasion when a particular aircrew member is selected for additional screening and that particular aircrew member may react negatively to such selection. It would be advantageous to have a video record of the individual aircrew member's protest for further counseling or other action to be taken by the airline regarding that individual aircrew member. Camera/video recording would also prove advantageous in immediate troubleshooting and later training for TSOs and other security access personnel to address certain routine and anomalous scenarios.

In embodiments, the disclosed schemes may facilitate a broad array of logistic support functions. The below-enumerated partial list of logistics support functions and system capabilities may be triggered by individuals, including individual aircrew members, presenting themselves at the security access control checkpoints, including separate security checkpoints in airports, to be localized and potentially then informed of any of a broad spectrum of selectable additional information. As the individual aircrew member enters the sterile area, for example, the airline may want to advise the individual aircrew member that his or her aircraft may not be available. The central coordination facility may act as a conduit for a decision from the airline regarding what to do with a particular aircrew or each individual aircrew member, e.g., send the individual home, send the individual to the crew lounge, send the individual to another flight, or the like. An SMS or other protocol "text" message may be generated and sent to the individual aircrew member's registered and participating personal mobile communication device advising the aircrew member to, for example, report to one of the listed destinations.

Separately, a capacity may be provided to, for example, monitor a time at which an aircrew member may have arrived in the airport environment. Such a capacity may be provided for an airline to monitor crew rest issues. A particular stakeholder (airline) may choose what information to collect and how it may choose to process and/or use that information.

The in-place technology today includes the scanning of barcodes at separate security checkpoints. This technology may be replaced by other wireless communication means, including the scanning of RFID chips, mounted in, or otherwise associated with, individual security credentials, to better localize positions of individuals. This scanning may provide, for example, an opportunity to re-task an individual aircrew member who may have time remaining in their crew day when scheduling, weather, and/or equipment issues arise. It should be understood that a broad spectrum of information and alert issues may be provided. Information, for example, may be provided to the lead pilot that the complete crew is assembled. Conversely, the lead pilot may be alerted that one or more of the aircrew members is not quite physically there at a time when the doors should be closing, but is "close." All manner of directed automated administrative information, including automatic terminal information, weather information, and/or Notice to Airmen information, to name a few, may be pushed to the aircrew, once the trigger of the individual aircrew member having presented him or herself at a particular security checkpoint occurs. In general then, the disclosed schemes may provide airlines with the capacity to accomplish more detailed crew monitoring and to automate crew dispatch and information sharing.

FIG. 1 illustrates an exemplary overview of an operating environment 100 in which secure, triggered and/or targeted communication schemes may be implemented according to this disclosure. As shown in FIG. 1, the exemplary operating environment 100 may encompass myriad lines of communication (wired or wireless) between a central coordination facility 110, acting as a type of central clearing house, and a number of widely dispersed nodes.

The widely dispersed nodes may include a plurality of access points 120,130,140,150, which may be broadly geographically dispersed for providing access, at some level of an access control threshold, to one or more access-controlled spaces, one or more access-controlled pieces of equipment and/or one or more access-controlled communicating or computing device components. In groups, one or more of the plurality of access points 120,130,140,150 may be geographically, or institutionally, co-located. In such circumstances, as is shown in FIG. 1, a local administrator server, unit or device 160 may exercise some level of local administrative control over the geographically, or institutionally, co-located access points 130,140. One or more of the plurality of access points 120,130,140,150, may be comprised of a fixed or mobile communicating/computing device, which may have associated with it an installed, or closely positioned, camera 125,135,145,155. The camera 125,135,145,155 may be positioned with its field of view capable of recording actions of individuals in a vicinity of the one or more of the plurality of access points 120,130,140,150. An objective of such camera positioning may be to record for later analysis any one of a security, operating, logistic or administrative anomaly or irregularity occurring in a vicinity of the access point 120,130,140,150. Whether the access point 120,130,140,150 is manned or not, an automated triggering algorithm or scheme may be employed to detect anomalous situations or other irregularities in a vicinity of the access point 120,130,140,150, thereby causing the camera 125,135,145,155 to automatically activate to record details in a vicinity of one of the plurality of access points 120,130,140,150 of circumstances that may be associated with the detected anomalous situation or other irregularity. Separately, a man-in-the-loop operator at the access point 120,130,140,150 may manually trigger the camera 125,135,145,155 to record details of situations that may arise that the operator determines to be at least one of irregular, anomalous or simply demanding a further review.

The widely-dispersed nodes may also include a plurality of entity-controlled databases 160-180. These databases may include company-controlled employee registers, or other individual registration lists, including, for example, government-maintained "no-fly" or other access control lists, by which the entity controlling any particular one of the databases may provide information regarding employee or other individual access authorization (or non-authorization) upon request. A premise behind the disclosed access control schemes is that no single entity may appropriately collect and hold the individual access authorization verification data as tightly as an originating entity that has a vested interest in most tightly controlling its own access verification information, and/or that there are competing or overlapping requirements regarding access control to any one or more of a particular space, piece of equipment, and/or communicating or computing device component. The originating entities are advantageously aided by the intervening clearing house structure, in the form of the central coordination facility 110, that receives the access requests and accesses the various databases to fulfill or respond to the access requests. In the disclosed embodiments, the central coordination facility 110 may be additionally employed, as discussed below, in a support role for collecting additional information from each one the access points 120,130,140,150 for later analysis and/or other purposes.

The central coordination facility 110 may comprise a proprietary communication integration methodology by which information from myriad stakeholders may be coordinated according to a particular menu of responses. That menu of responses may be selectable by one or more individuals, such as in the form of a drop-down menu that may be manually manipulated or may be directed by any one of the myriad stakeholders in the communication coordination system identifying groups or sub-groups of individuals to receive certain communications in response to certain triggering events. The central coordination facility 110 may have associated with it, as an integral component, or as a separate connected component, a system pre-planned response coordinating device 115. The system pre-plan response coordinating device 115 may be usable for storing databases of (1) individuals that have pre-registered their mobile communication devices, for example, with a particular database maintained by the central coordination facility 110, or (2) a plurality of groups or sub-groups that have been identified by one of the stakeholders. Such a system pre-planned response coordinating device 115 may be used to provide pre-planned responses in an event of one or more of (1) a system or local operating anomaly; (2) a system or local operating irregularity; (3) updated security, operating, logistic, and/or administrative information that may be triggered by identification of a particular individual at one or more of the plurality of access points 120,130,140,150; and/or (4) upon triggering initiated by user input the one or more of the plurality of access points 120,130,140,150. Additionally, the system pre-planned response coordinating device 115 may be usable to provide to individuals, identified sub-groups, or identified groups in a manner of security, operating, logistic, and/or administrative information provided by the entities controlling the entity-controlled databases 160-180 in instances in which (1) the central coordination facility 110 is alerted to a presence of a particular individual at an access point 120,130,140,150 attempting to gain access to that access point 120,130,140,150 once cleared through coordination with one or more of the entity controlled databases 160-180; or (2) the central coordination facility 110 is alerted to an anomalous or irregular situation at one or more of the plurality of access points 120,130,140,150. The central coordination facility 110 may be alerted to the anomalous or irregular situation based on automated data acquisition input from one of the plurality of access points 120,130,140,150, such as through sensor input or camera detection. Separately, or additionally, the central coordination facility 110 may be alerted to the anomalous or irregular situation based on user input from the one of the plurality of access points 120,130,140,150.

In a normal course of operation, individuals will present themselves at individual ones of the plurality of access points 120,130,140,150 to request access to any one of a controlled space, controlled piece of equipment, controlled communicating or computer device component, or the like with which the individual ones of the plurality of access points 120,130, 140,150 may be associated. The individual access requests may be forwarded to the central coordination facility 110, and include identification of the individual and identification of which of a plurality of entity-controlled databases 160-180 may hold the individual's access authorizations. The central coordination facility 110 may then query the identified one of the plurality of entity-controlled databases 160-180 to obtain the individual's access authorization for the particular space, piece of equipment or communication or computing device component with which the one of the plurality of access points 120,130,140,150 at which the individual presented himself or herself is associated. With a verification of the individual's access authorization for the particular space, piece of equipment or device component, the central coordination facility 110 may forward appropriate access authorization information to the appropriate one of the plurality of access points 120, 130,140,150 and the individual may be granted access.

In a circumstance where the central coordination facility 110 is unable to obtain the individual's access authorization for the particular space, piece of equipment or device, the central coordination facility 110 may forward appropriate information to the access point denying the individual's access.

Regardless of whether a particular individual is authorized or denied access via a particular one of the plurality of access points 120, 130, 140, 150, the central coordination facility may review data in the system pre-planned response coordinating device 115 to determine whether there is any particular security, operating, logistic or administrative information that should be forwarded to one of the access point itself, or to a registered personal mobile communicating device (RPMCD) 192-198 that the individual has previously registered with the entity with whom the individual is associated. Categories of information may include one or more of those pieces of information enumerated in detail above for an understanding of current security, operating, logistic and/or administrative use. On each occurrence in which the system pre-planned response coordinating device 115 determines that particular information may be sent to one or more end users based on a pre-planned or on-call response scenario, the system pre-planned response coordinating device 115 may select from one or more pre-planned responses, may fill in blanks in the one or more pre-planned response based on up to the moment real-time update of one or more of the security, operating, logistic or administrative information, and may apply an appropriate level of security classification or access control to the information according to a specified security level and/or information access control scenario before transmitting the information to an individual, a sub-group, a group, or any one or more users and/or stakeholders to whom the information should be beneficially directed.

When a particular scenario calls for additional information or other response from one or more of the plurality of access points 120,130,140,150, the central coordination facility 110, via its system pre-planned response coordinating device 115, or otherwise, may send one or more inquiries to the one or more of the plurality of access points 120,130,140,150 or the RPMCD 192-198 of one or more individuals and expect some combination of pre-planned responses in return. Generally, the central coordination facility 110 will locally or remotely coordinate storage of the collected information to one of a number of beneficial purposes, including later incident reconstruction and/or analysis.

Figure 2:
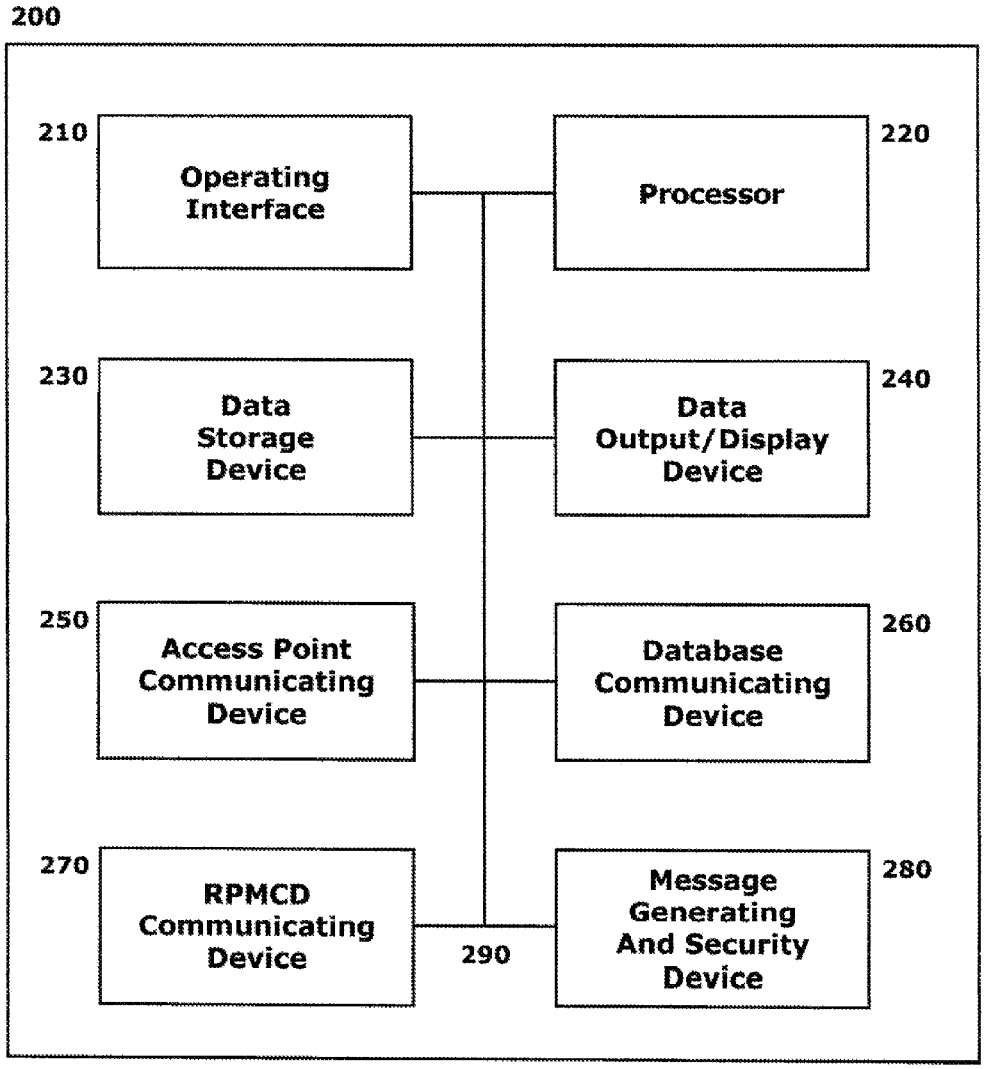
FIG. 2 illustrates an exemplary data collection, analysis and communicating device, components of which may be housed in a central coordination facility for implementing network-connected secure and targeted communication schemes according to this disclosure.

FIG. 2 illustrates an exemplary data collection, analysis and communicating device 200, components of which may be housed in a central coordination facility for implementing network-connected secure and targeted communication schemes according to this disclosure. The exemplary device 200 shown in FIG. 2 may be implemented as a unit in the central coordination facility (element 110 in FIG. 1), or may be implemented as a combination of system components associated with the central coordination facility, including as cloud-based processing and data storage components.

The exemplary device 200 may include an operating interface 210 by which a user may communicate with the exemplary device 200 for directing at least a mode of operation of the exemplary device 200 in implementing its secured and targeted communicating functions for transferring pre-determined information to one or more of an access control unit at a security access control checkpoint or to a registered personal mobile device for a participating individual according to some triggering event. Control inputs received in the exemplary device 200 via the operating interface 210 may be processed and communicated to any one of the many connected nodes in communication with the central coordination facility, including a plurality of access point control units and a plurality of individual entity-controlled access authorization databases. The operating interface 210 may be a part or a function of a graphical user interface (GUI) mounted on, integral to, or associated with, the exemplary device 200. The operating interface 210 may alternatively take the form of any commonly user-interactive device by which a user input and/or command are input to an automated processing system including, but not limited to, a keyboard or a touchscreen, a mouse or other pointing device, a microphone for providing verbal commands, or any other commonly-known operating interface device.

The exemplary device 200 may include one or more local processors 220 for carrying out the individual operations and functions of the exemplary device 200. The processor 220 may reference, for example, each access request and each response to an access request to monitor overall system stability and to determine instances in which additional security, operating, logistic or administrative information should be passed, at an appropriate security level to an access control unit at a security access control checkpoint or to a registered personal mobile device for a participating individual who has recently gained access via the security access control checkpoint. The processor 220 may initiate a database query to determine whether one of more of the stakeholders, including various database controlling entities has registered a set of pre-planned informational responses to, for example, be passed to the participating individual's registered personal mobile device. Such information may be found in a local database in the central coordination facility or may be separately available in one or more of the entity-controlled databases.

The exemplary device 200 may include one or more data storage devices 230. Such data storage device(s) 230 may be used to store data or operating programs to be used by the exemplary device 200, and specifically the processor(s) 220 in carrying into effect the disclosed operations and functions. Data storage device(s) 230 may be used to store information regarding each access request and each response to an access request in order that the processor 220 in the exemplary device 200 may assess particular trends in communication with one or more of the external entity-controlled databases with which the central coordination facility communicates. Additionally, data storage device(s) 230 may store a series of pre-planned responses for certain automated or manual triggering events initiated at one or more of the plurality of access control units. Data storage device(s) 230 may also store information regarding the triggering events, and responses thereto, for later analysis.

The data storage device(s) 230 may include a random access memory (RAM) or another type of dynamic storage device that is capable of storing updatable database information, and for separately storing instructions for execution of system operations by, for example, processor(s) 220. Data storage device(s) 230 may also include a read-only memory (ROM), which may include a conventional ROM device or another type of static storage device that stores static information and instructions for processor(s) 220. Further, the data storage device(s) 230 may be integral to the exemplary device 200, or may be provided external to, and in wired or wireless communication with, the exemplary device 200, including as cloud-based storage and/or processing elements.

The exemplary device 200 may include at least one data output/display device 240, which may be configured as one or more conventional mechanisms that output information to a user, including, but not limited to, a display screen on a GUI associated with the exemplary device 200 to provide feedback to local technical personnel regarding detected, triggered and/or confirmed anomalous conditions or irregularities at one or more of the plurality of access units at the security access control checkpoints. The data output/display device 240 may be used to indicate to local technical personnel any information that may be usable by those local technical personnel in assisting in manually remediating the detected, triggered and/or confirmed anomalous conditions or irregularities or for simply monitoring any automated response schemes.

The exemplary device 200 may include at least one external data communication interface 250 by which the exemplary device 200 may communicate with external data and information systems to collect real-time data that may populate a formatted message to provide to a participating individual's registered personal mobile device. In the aircrew member scenario described above, for example, the information may include current weather information for the departure and destination airports, as well as the enroute weather and weather forecasts, automated terminal information, Notice to Airmen information, up-to-the-minute crew locator information and the like. Also, in circumstances where the exemplary device 200 is not an integral component of the clearance systems in the central coordination facility, the exemplary device 200 may communicate with those clearance systems, for example, for recording access requests and responses to access requests via those clearance systems, through a particularly configured at least one external data communication interface 250.

The exemplary device 200 may include its own database communicating device 260, which may be used, for example, to provide separate communications to the entity-controlled databases for collecting access authorization verification information from those databases and separately, any entity-controlled pre-planned communications to be transmitted by the central coordination facility to the participating individuals' registered personal mobile devices via an RPMCD communicating device 270 that is usable to appropriately forward the requested information on an event of the individual passing through a particular security checkpoint.

The exemplary device 200 may include a message generating and security device 280. The message generating and security device 280 may be a function of the processor 220 in communication with the data storage device 230, or may be a stand-alone device or unit within the exemplary device 200. When a stand-alone device or unit within the exemplary device 200, the message generating and security device 280 may itself reference information from other components, including but not limited to the database communicating device 260 to determine whether and what actions may be appropriate to respond to any triggering event according to any particular stakeholder's pre-planned response scenarios, and then to formulate a message and to appropriately secure that message for transmission via at least one of the access point communicating device 250 and the RPMCD communicating device 270.

All of the various components of the exemplary device 200, as depicted in FIG. 2, may be connected internally, and potentially to a central coordination facility, by one or more data/control busses 290. These data/control busses 290 may provide wired or wireless communication between the various components of the exemplary device 200, whether all of those components are housed integrally in, or are otherwise external and connected to, other components of an overarching access control system with which the exemplary device 200 may be associated.

It should be appreciated that, although depicted in FIG. 2 as an essentially integral unit, the various disclosed elements of the exemplary device 200 may be arranged in any combination of sub-systems as individual components or combinations of components, integral to a single unit, or external to, and in wired or wireless communication with, the single unit of the exemplary device 200. In other words, no specific configuration as an integral unit or as a support unit is to be implied by the depiction in FIG. 2. Further, although depicted as individual units for ease of understanding of the details provided in this disclosure regarding the exemplary device 200, it should be understood that the described functions of any of the individually-depicted components may be undertaken, for example, by one or more processors 220 connected to, and in communication with, one or more data storage device(s) 230, all of which may support operations in the associated access control system.

Figure 3:
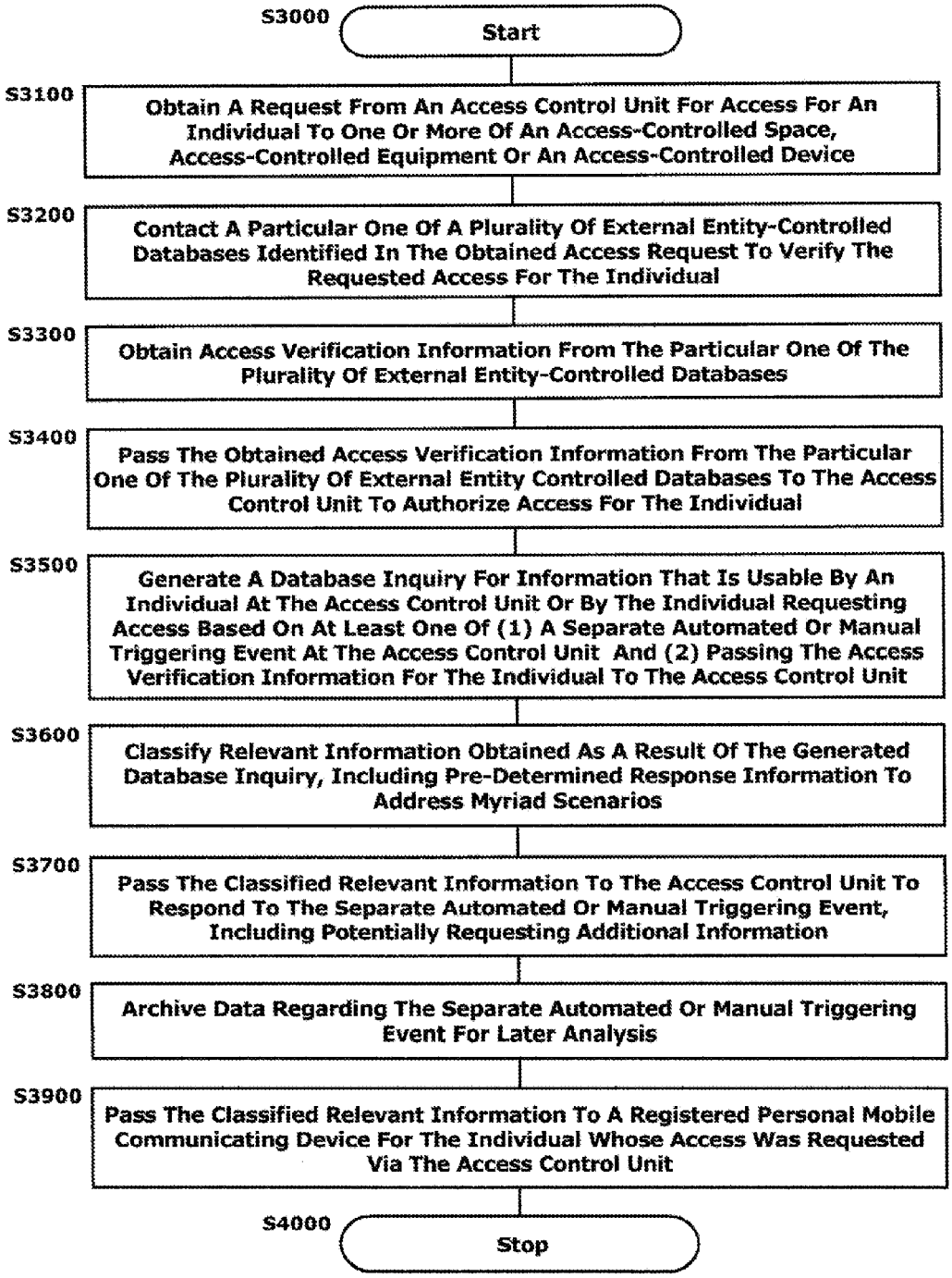
FIG. 3 illustrates a flowchart of an exemplary method for implementing network connected secure and targeted communication schemes according to this disclosure.

The disclosed embodiments may include an exemplary method for implementing network connected secure and targeted communication schemes. FIG. 3 illustrates an exemplary flowchart of such a method. As shown in FIG. 3, operation of the method commences at Step S3000 and proceeds to Step S3100.

In Step S3100, a request for access for an individual to one or more of an access-controlled space, an access-controlled piece of equipment or an access-controlled computing or communicating device may be obtained from an access control unit associated with the space, piece of equipment or device. Operation of the method proceeds to Step S3200.

In Step S3200, a particular one of a plurality of external entity-controlled databases identified in the request for access may be contacted to verify authorization for the requested access for the individual. Operation of the method proceeds to Step S3300.

In Step S3300, access verification information may be obtained from the particular one of the plurality of external entity-controlled databases. Operation of the method proceeds to Step S3400.

In Step S3400, when access verification information (including potentially access denial information) is obtained from the particular one of the plurality of external entity-controlled databases, the access verification information may be passed to the requesting access control unit to authorize (or deny) access for the individual to the space, piece of equipment or device. Operation of the method proceeds to Step S3500.

In Step S3500, a separate database inquiry may be generated. The generated database inquiry may seek information that may be usable for an individual at the access control unit, and/or by the individuals presenting themselves for access. The database inquiry may be generated based on one or more of an automated incident detection at the access control unit, a manual input from an individual at the access control unit, or simply the request for, and occurrence of, access authorization of an individual via the access control unit. Operation of the method proceeds to Step S3600.

In Step S3600, obtained relevant information may be appropriately classified, or access restricted, according to some protocol established by the central coordination facility or by any one or more of the entities or stakeholders controlling the various verification and communication databases. Operation of the method proceeds to Step S3700.

In Step S3700, the classified relevant information may be passed to the access control unit in response to the triggering event at the access control unit. The response may, for example, include guidelines for actions to be taken by the individual at the access control unit to resolve a detected anomalous situation or irregularity. The response may, in such instances, also provide a list of pre-planned questions to be answered by the individual at the access control unit for data collection regarding the anomalous situation or irregularity. Operation of the method proceeds to Step S3800.

In Step S3800, all received data regarding the anomalous situation or irregularity may be collected and archived for later, including on-call, analysis. Operation of the method proceeds to Step S3900.

In Step S3900, the classified relevant information may be passed to a registered personal mobile communicating device for the individual whose access was requested via the access control unit. Broad categories of security, operating, logistic and/or administrative information may be passed to the benefit of the individual as the individual or the stakeholder may have pre-selected. The response may, in such instances, also provide a list of pre-planned questions to be answered by the individual for data collection and/or update. Operation of the method proceeds to Step S4000, where operation of the method ceases.

The disclosed embodiments may include a non-transitory computer-readable medium storing instructions which, when executed by a processor, may cause the processor to execute all, or at least some, of the functions that may be appropriate to implement the steps of the method outlined above.

The above-described exemplary systems and methods reference certain conventional communicating and/or computing components to provide a brief, general description of suitable operating environments in which the subject matter of this disclosure may be implemented for familiarity and ease of understanding. Although not required, embodiments of the disclosed systems, and implementations of the disclosed methods, may be provided and executed, at least in part, in a form of hardware circuits, firmware, or software computer-executable instructions to carry out the specific functions described. These may include individual program modules executed by one or more processors. Generally, program modules include routine programs, objects, components, data structures, and the like that perform particular tasks or implement particular data types in support of the overall objective of the systems and methods according to this disclosure.

Those skilled in the art will appreciate that other embodiments of the disclosed subject matter may be practiced in integrating access control techniques using many and widely-varied system components.

As indicated above, embodiments within the scope of this disclosure may also include computer-readable media having stored computer-executable instructions or data structures that can be accessed, read and executed by one or more processors in differing devices, as described. Such computer-readable media can be any available media that can be accessed by a processor, general purpose or special purpose computer. By way of example, and not limitation, such computer-readable media can comprise RAM, ROM, EEPROM, CD-ROM, flash drives, data memory cards or other analog or digital data storage device that can be used to carry or store desired program elements or steps in the form of accessible computer-executable instructions or data structures. When information is transferred or provided over a network or another communication connection, whether wired, wireless, or in some combination of the two, the receiving processor properly views the connection as a computer-readable medium. Thus, any such connection is properly termed a computer-readable medium. Combinations of the above should also be included within the scope of the computer-readable media for the purposes of this disclosure.

Computer-executable instructions include, for example, non-transitory instructions and data that can be executed and accessed respectively to cause a processor to perform certain of the above-specified functions, individually or in various combinations. Computer-executable instructions may also include program modules that are remotely stored for access and execution by a processor.

The exemplary depicted sequence of executable instructions or associated data structures represent one example of a corresponding sequence of acts for implementing the functions described in the steps of the above-outlined exemplary method. The exemplary depicted steps may be executed in any reasonable order to carry into effect the objectives of the disclosed embodiments. No particular order to the disclosed steps of the method is necessarily implied by the depiction in FIG. 3, except where execution of a particular method step is a necessary precondition to execution of any other method step.

Although the above description may contain specific details, they should not be construed as limiting the claims in any way. Other configurations of the described embodiments of the disclosed systems and methods are part of the scope of this disclosure. It will be appreciated that various of the above-disclosed and other features and functions, or alternatives thereof, may be desirably combined into many other different systems or applications. Although the above description may contain specific details, they should not be construed as limiting the claims in any way. Other configurations are part of the scope of the disclosed embodiments. For example, the principles of the disclosed embodiments may be applied to each individual access unit and each individual external entity-controlled database that may individually reliably employ components of the disclosed system. This enables each access unit and/or database to enjoy the benefits of the disclosed embodiments even if any one of the large number of possible end-user nodes do not need some portion of the described functionality. In other words, there may be multiple instances of the disclosed system each processing the content in various possible ways. It does not necessarily need to be one system used by all end-user nodes. Accordingly, the appended claims and their legal equivalents should only define the disclosed embodiments, rather than any specific examples given.

We claim:

1. A system for implementing access control, comprising:

a first communicating device that is configured to communicate with a plurality of access control checkpoint components at a plurality of access control checkpoints controlled by a first entity, each of the access control checkpoint components being used to gain access to at least one of an access-controlled space, access-controlled equipment and an access controlled device;

a second communicating device that is configured to separately communicate with a plurality of access control databases, each one of the plurality of access control databases (1) being controlled by a second entity and (2) containing information maintained by the second entity for individual access verification, the second entity being a different entity from the first entity;

an access resolution device that is configured to receive, via the first communicating device, an access request generated by a first one of the plurality of access control checkpoint components, the received access request including (1) identifying information for an individual seeking access verification via the first one of the plurality of access control checkpoints and (2) an identification of the one of the plurality of access control databases containing the information for the individual access verification, initiate a query, via the second communicating device, of the identified one of the plurality of databases containing the information for the individual access verification according to the identifying information in the received access request, receive, via the second communicating device, individual access verification information from the identified one of the plurality of databases, and forward, via the first communicating device, the received individual access verification information to the first one of the plurality of access control checkpoint components; and a message transmission device that is configured to receive information regarding an anomalous occurrence in a vicinity of the first one of the plurality of access control checkpoint components, search one or more message and information databases to retrieve messaging information for directing a response to the anomalous occurrence at the first one of the plurality of access control checkpoint components or for directing a supporting response to the anomalous event at a second one of the plurality of access control checkpoint components via the first communicating device, generate a data transmission based the retrieved messaging information, and send the generated data transmission to at least one receiving node.

2. The system of claim 1, the receiving node being a personal mobile communicating device of the individual seeking access verification, and the messaging information comprising information directing actions to be taken by the individual seeking access verification for responding to the anomalous occurrence.

3. The system of claim 2, the messaging information comprising a selectable list of pre-planned actions for responding to the anomalous occurrence.

4. The system of claim 3, the message transmission device generating the data transmission based on one of the selectable list of pre-planned actions.

5. The system of claim 1, the anomalous occurrence causing a signal to be generated by at least one of the plurality of access control checkpoint components and transmitted for receipt by the message transmission device.

6. The system of claim 5, the receiving node being the at least one of the plurality of access control checkpoint components from which the signal is received by the message transmission device.

7. The system of claim 6, the messaging information providing a pre-determined response to an operator at the at least one of the access control checkpoint components from which the signal is received by the message transmission device to address the detected anomalous occurrence.

8. The system of claim 5, the signal being generated based on a manual input by an operator of the at least one of the plurality of access control checkpoint components upon detection of the anomalous occurrence.

9. The system of claim 5, the signal being generated based on an automated detection of the anomalous occurrence by a sensor associated with the at least one of the plurality of access control checkpoint components.

10. The system of claim 9, the sensor being a camera in a vicinity of the at least one of the plurality of access control checkpoint components.

11. The system of claim 1, the messaging information further comprising at least one of a security classification and an accessibility control for the messaging information that is included in the generated data transmission to restrict access to the messaging information sent to the at least one receiving node.

12. A method for implementing access control and communication to one or more receiving nodes, comprising:

receiving, by a processor, an access request generated by at least one of a plurality of access control checkpoint components, the plurality of access control checkpoint components being used to gain access to at least one of an access-controlled space, access-controlled equipment and an access-controlled device, the access request (1) identifying an individual requesting access verification and (2) an identification of a particular one of a plurality of access control databases containing information for individual access verification;

initiating a query, by the processor, of the identified one of the plurality of access control databases containing the information for the individual access verification according to the identifying information in the received access request;

receiving, by the processor, individual access verification information from the identified one of the plurality of databases;

forwarding, by the processor, the received individual access verification information to the at least one of the plurality of access control checkpoint components from which the access request is received;

receiving, by the processor, information regarding an anomalous occurrence in a vicinity of the at least one of the plurality of access control checkpoint components searching, by the processor, one or more message and information databases to retrieve messaging information directing a response to the anomalous occurrence at the at least one of the plurality of access control checkpoint components;

generating, by the processor, a data transmission based on the retrieved messaging information; and sending, by the processor, the generated data transmission to at least one receiving node.

13. The method of claim 12, the receiving node being a personal mobile communicating device of the individual seeking access verification, and the messaging information comprising directing actions to be taken by the individual seeking access verification for responding to the anomalous occurrence.

14. The method of claim 13, the messaging information comprising a selectable list of pre-planned actions for responding to the anomalous occurrence.

15. The method of claim 14, the processor generating the data transmission based on one of the selectable list of pre-planned actions.

16. The method of claim 12, the anomalous occurrence causing a signal to be generated by and transmitted for receipt by the processor.

17. The method of claim 16, the receiving node being the at least one of the plurality of access control checkpoint components from which the signal is received by the processor.

18. The method of claim 17, the messaging information providing a pre-determined response to an operator at the at least one of the plurality of access control checkpoint components from which the signal is received by the processor to address the detected anomalous occurrence.

19. The method of claim 16, the signal being generated based on a manual input by an operator of the at least one of the plurality of access control components upon detection of the anomalous occurrence.

20. The method of claim 16, the signal being generated based on an automated detection of the anomalous occurrence by a sensor associated with the at least one of the plurality of access control checkpoint components.

21. The method of claim 20, the sensor being a camera in a vicinity of the at least one of the plurality of access control checkpoint components.

22. The method of claim 12, the messaging information further comprising at least one of a security classification and an accessibility control for the messaging information that is included in the generated data transmission to restrict access to the messaging information sent to the at least one receiving node.

23. A non-transitory data storage medium storing instructions that, when executed by a processor, cause the processor to execute the steps of a method for implementing access control and communication to one or more receiving nodes, the method comprising:

receiving an access request generated by at least one of a plurality of access control checkpoint components, the plurality of access control checkpoint components being used to gain access to at least one of an access-controlled space, access-controlled equipment and an access-controlled device, the access request (1) identifying an individual requesting access verification and (2) an identification of a particular one of a plurality of access control databases containing information for individual access verification;

initiating a query of the identified one of the plurality of access control databases containing the information for the individual access verification according to the identifying information the received access request;

receiving individual access verification information from the identified one of the plurality of databases;

forwarding the received access verification information to the at least one of the plurality of access control checkpoint components from which the access request is received;

receiving information regarding an anomalous occurrence in a vicinity of at least one of the plurality of access control checkpoint components;

searching one or more message and information databases to retrieve messaging information directing response to the anomalous occurrence at the at least one of the plurality of access control checkpoint components;

generating a data transmission based on the retrieved messaging information; and sending the generated data transmission to at least one receiving node.

* * * * *